US007469431B2

(12) United States Patent
Mauro et al.

(10) Patent No.: US 7,469,431 B2
(45) Date of Patent: Dec. 30, 2008

(54) NESTABLE BOX SPRING FOUNDATION

(75) Inventors: Fausto Mauro, Woodbridge (CA); Vito Mauro, Brampton (CA); Rick McIntosh, Mississauga (CA)

(73) Assignee: Stelpro Wire & Springs, Inc., Ontario (CA)

( * ) Notice: Subject to any disclaimer, the term of this patent is extended or adjusted under 35 U.S.C. 154(b) by 0 days.

(21) Appl. No.: 11/304,979

(22) Filed: Dec. 15, 2005

(65) Prior Publication Data

US 2007/0124860 A1 Jun. 7, 2007

(30) Foreign Application Priority Data

Dec. 7, 2005 (CA) ..... 2529391

(51) Int. Cl.
*A47C 23/00* (2006.01)

(52) U.S. Cl. ..... 5/247

(58) Field of Classification Search ..... 5/246–247, 5/254–255, 260; 267/95, 103–107
See application file for complete search history.

(56) References Cited

U.S. PATENT DOCUMENTS

| | | | |
|---|---|---|---|
| 2,415,765 | A | 2/1947 | Schmidt |
| 2,560,842 | A | 7/1951 | Blumensaadt et al. |
| 3,286,281 | A | 11/1966 | Slominski |
| 3,546,723 | A | 12/1970 | Ciampa et al. |
| 3,725,965 | A | 4/1973 | Smith et al. |
| 3,777,322 | A | 12/1973 | Larkin |
| 3,825,960 | A | 7/1974 | Inman et al. |
| 3,916,463 | A | 11/1975 | Higgins |
| 4,069,525 | A | 1/1978 | Valoff |
| 4,101,992 | A | 7/1978 | Levine et al. |
| 4,251,892 | A | 2/1981 | Hancock |
| 4,339,834 | A | 7/1982 | Mizelle |
| 4,377,279 | A | 3/1983 | Schulz, Jr. et al. |
| 4,398,705 | A | 8/1983 | Mizelle |
| 4,452,438 | A | 6/1984 | Hancock et al. |
| 4,470,584 | A | 9/1984 | Mizelle |
| 4,489,450 | A | 12/1984 | Miller |
| 4,559,654 | A | 12/1985 | Mizelle |
| 4,595,181 | A | 6/1986 | Hagemeister |
| 4,620,336 | A | 11/1986 | Miller |
| 4,654,905 | A | 4/1987 | Miller |
| 4,666,136 | A | 5/1987 | Hagemeister |
| 4,685,162 | A | 8/1987 | Higgins et al. |
| 4,685,169 | A | 8/1987 | Nelson |
| 4,704,752 | A | 11/1987 | Yates et al. |
| 4,721,920 | A | 1/1988 | Poletto et al. |

(Continued)

FOREIGN PATENT DOCUMENTS

| | | |
|---|---|---|
| EP | 0 192 890 B2 | 4/1985 |

(Continued)

*Primary Examiner*—Fredrick Conley
(74) *Attorney, Agent, or Firm*—Harness, Dickey & Pierce, P.L.C.

(57) ABSTRACT

The invention provides a nestable box spring foundation having a generally rectangular perimeter divided into a plurality of rectangular openings by a grid of longitudinally and laterally extending wires. Support is provided by a pair of generally U-shaped wire members mounted at their ends to adjacent grid wires. The members are of simple configuration and accordingly inexpensive to manufacture, simple to attach such as by welding and by virtue of their symmetry provide good lateral strength.

16 Claims, 4 Drawing Sheets

U.S. PATENT DOCUMENTS 4,729,550 A 3/1988 Hagemeister
4,730,357 A 3/1988 Wells
4,730,358 A 3/1988 Zapletal
4,739,977 A 4/1988 Dabney
4,760,616 A 8/1988 Hiatt et al.
4,766,625 A 8/1988 Yates et al.
4,770,397 A 9/1988 Schulz, Jr.
4,771,995 A 9/1988 Wells et al.
4,776,572 A 10/1988 Surletta et al.
4,805,883 A 2/1989 Kitchen
4,862,531 A 9/1989 Wells
4,862,532 A 9/1989 Wells et al.
4,891,853 A 1/1990 Dabney
4,896,386 A 1/1990 Ogle et al.
4,903,949 A 2/1990 Schulz, Jr.
4,921,228 A 5/1990 Lowe
4,995,125 A 2/1991 Dennison
5,005,809 A 4/1991 Harmon
5,052,064 A 10/1991 Hagemeister et al.
5,142,716 A 9/1992 Ogle et al.
5,152,509 A 10/1992 Wells et al.
5,165,667 A 11/1992 Dabney
5,178,382 A 1/1993 Chung et al.
5,188,344 A 2/1993 Dabney
5,197,155 A 3/1993 Ogle et al.
5,231,712 A 8/1993 Edwards et al.
5,246,210 A 9/1993 Dabney et al.
5,265,291 A 11/1993 Callaway
5,346,188 A 9/1994 Rodgers et al.
5,346,190 A 9/1994 Dabney
5,361,434 A 11/1994 Hagemeister et al.
5,369,822 A 12/1994 Dennison
5,370,374 A 12/1994 Rodgers et al.
5,395,097 A 3/1995 Dabney et al.
5,499,414 A 3/1996 Dillon
5,551,104 A 9/1996 Hartline
5,558,315 A 9/1996 Constantinescu et al.
5,704,595 A * 1/1998 Kitchen et al. ..... 267/103
5,967,499 A 10/1999 McCraw et al.
6,032,307 A 3/2000 Workman
6,108,834 A 8/2000 Mauro et al.
6,419,212 B1 7/2002 Arnold et al.
6,484,339 B2 11/2002 Mossbeck et al.
6,588,035 B2 7/2003 Le Duc et al.
6,651,276 B2 11/2003 McCraw et al.

FOREIGN PATENT DOCUMENTS

EP 0 814 689 B1 11/1996

* cited by examiner

NESTABLE BOX SPRING FOUNDATION

FIELD OF THE INVENTION

This invention relates generally to bedding. More specifically this invention relates to box spring foundations, and in particular to nestably stackable box spring foundations.

BACKGROUND TO THE INVENTION

In the past, box spring foundations comprised a pair of generally rectangular border wires which were spaced apart by coil or bent wire spring modules. A problem with such earlier designs is that they are bulky to ship to a bedding manufacturer for securement to a slat base and the application of padding and covering. The bulkiness results from having an open wire structure with no capability of nestable stacking.

Early foundation designs were resiliently collapsed (compressed) for shipping and held in the collapsed state with ties. This however required both the application and removal of ties which is both time consuming and wasteful. Furthermore, such a degree of resiliency may be undesirable at least in some applications.

In order to avoid having to compress and restore a foundation, later designs provided for either nestably stackable configurations or hingedly collapsible arrangements. U.S. Pat. Nos. 5,346,188 to Rodgers et al and 5,622,357 to Schulz Jr. et al are examples of a folding arrangement. U.S. Pat. Nos. 6,484,339B2 to Mossbeck et al and 5,967,499 to McGraw et al are examples of the latter arrangement.

The foregoing designs each have shortcomings. The hingedly collapsible arrangements tend to be more complex as hinging must be provided to enable collapse. Once erected however hinging is no longer desirable as it affects the inherent lateral stability of the design. Some of the nesting designs have complicated (and therefore more difficult and costly to manufacture) support elements. Others are less laterally stable than might be desirable. Still others have relatively labour intensive attachment arrangements for connecting the structural elements.

Objects of the present invention include providing a nestably stackable box spring foundation which is simple to manufacture, cost effective and robust.

SUMMARY OF THE INVENTION

In very general terms, the invention provides a nestable box spring foundation having a generally rectangular perimeter divided into a plurality of rectangular openings by a grid of longitudinally and laterally extending wires. Support is provided by a pair of generally U-shaped wire members mounted at their ends to adjacent grid wires. The members are of simple configuration, inexpensive to manufacture, simple to attach such as by welding and, by virtue of their symmetrical pyramidal shape, provide good lateral strength.

More particularly, a nestable box spring foundation is provided which has a generally rectangular perimeter frame and a grid having longitudinally and laterally extending grid wires secured at opposite ends to the perimeter frame to define a plurality of generally rectangular openings across the perimeter frame. The foundation has generally U-shaped support members each having a pair of legs joined at respective base ends thereof to a base member and spaced apart at respective outer ends thereof opposite the respective base ends. The support members are mounted in pairs within at least some of the openings with the outer ends being secured to the grid wires and the base ends of the pairs adjacent, to define a plurality of open, generally pyramidal supports opening toward but extending away from the grid for supporting the grid and in turn the perimeter frame. The supports are nestable in corresponding supports of an adjacent nestable box spring foundation.

The support members may be mounted in the aforesaid pairs in alternate of the rectangular openings.

The legs of the support members may diverge toward the outer ends and the outer ends may be secured either to the longitudinally extending grid wires or to the laterally extending grid wires.

The perimeter frame may have opposite sides and opposite ends. The longitudinally extending grid wires may be generally parallel to the sides and the latterly extending grid wires may be generally parallel to the ends.

The grid wires may be secured to one another and to the perimeter of the frame by welding. The outer ends of the legs may be secured to the grid wires by welding.

The legs of the support members may bend towards the grid wires to which they attach adjacent their outer ends.

The support members may attach to the longitudinally extending grid wires.

Characterized in another way, a nestably stackable box spring foundation is provided which has a generally rectangular perimeter frame having opposite sides and opposite ends. The foundation further has a grid having longitudinally and laterally extending wires to define grid openings, the longitudinally extending wires being generally parallel to the sides and secured to the ends, the laterally extending wires being generally parallel to the ends and secured to the sides. A plurality of nestable supports extend away from the grid to support the grid and in turn the perimeter frame. The supports further have a pair of generally U-shaped support members each of the generally U-shaped support members having a pair of legs extending away from respective adjacent base portions toward respective outer ends thereof and each of the generally U-shaped support members being attached at its respective outer ends to a different one of an adjacent pair of the laterally extending or the longitudinally extending wires.

The supports may be arranged in rows and columns with adjacent of the supports being spaced apart from each other by a grid opening.

The legs of each support member may diverge from the base toward the outer ends. The legs and support members may be bent adjacent their outer ends toward the wires to which they attach.

The grid wires may be secured to one another and the perimeter frame by welding and the outer ends may be attached to the wires by welding.

DESCRIPTION OF DRAWINGS

Preferred embodiments of the invention are described in detail below with reference to the accompanying illustrations in which:

FIG. 4 is an end elevation corresponding to the arrow 4 in FIG. 1, the opposite end would appear similar;

DESCRIPTION OF PREFERRED EMBODIMENTS

Figure 1:
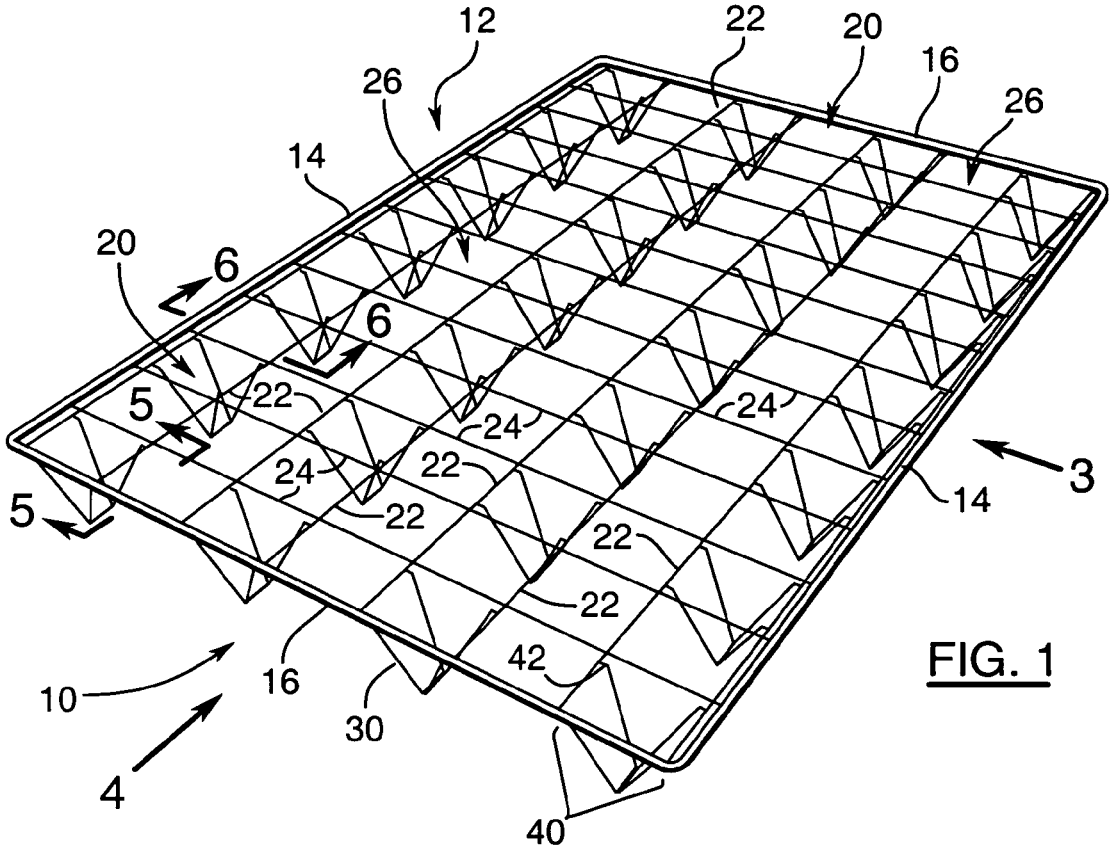
FIG. 1 is a perspective view from above of a nestable box spring foundation according to the present invention.
Figure 2:
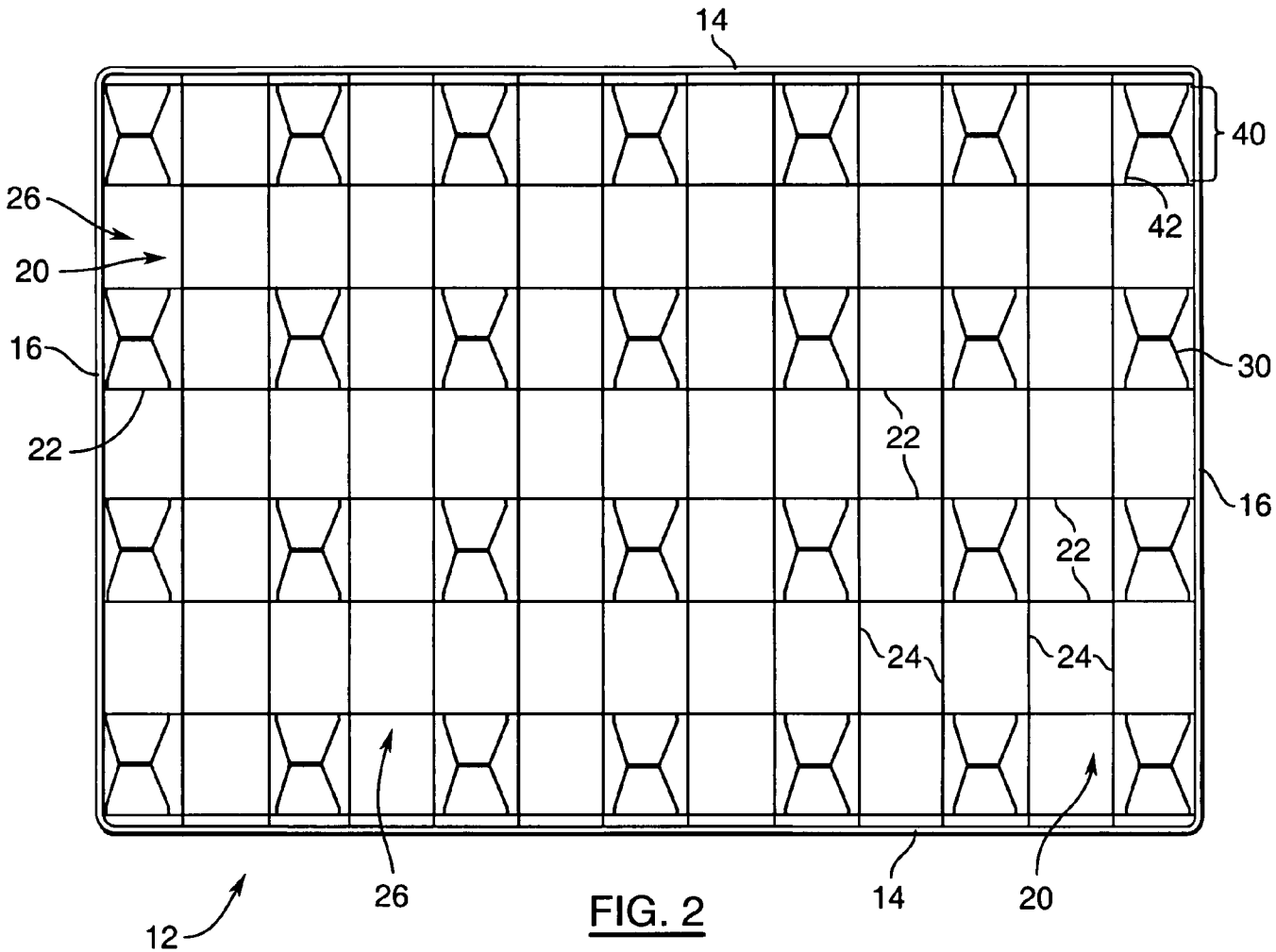
FIG. 2 is a top plan view corresponding to FIG. 1.
Figure 3:
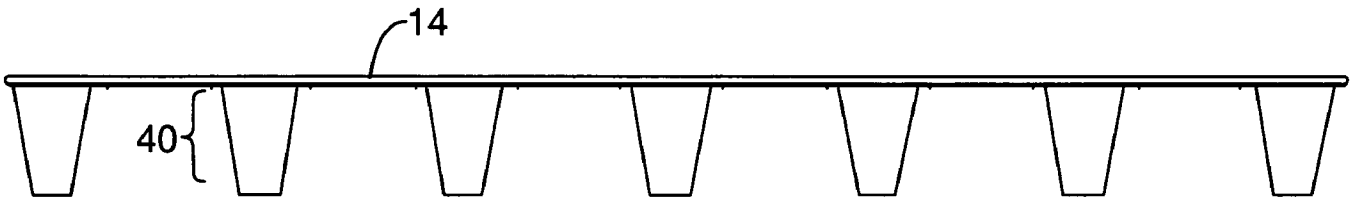
FIG. 3 is a side elevation corresponding to the arrow 3 in FIG. 1, the view would be the same from either side.
Figure 4:
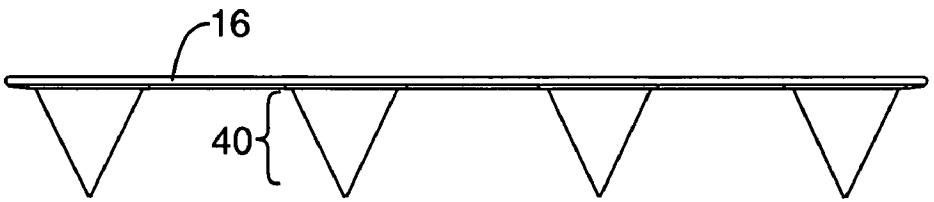

A nestable box spring foundation according to the present invention is generally indicated by reference 10 in the accompanying illustrations. The nestable box spring foundation has a generally rectangular perimeter frame 12 having opposite sides 14 and opposite ends 16. A grid 20 is secured to the frame. The grid has longitudinally extending wires 22 and laterally extending wires 24. The longitudinally extending wires 22 extend between and are secured to the opposite ends 16 and run generally parallel to the opposite sides 14. The laterally extending wires 24 extend between and are secured to the opposite sides 14 and run generally parallel to the opposite ends 16.

Generally U-shaped support members 30 are provided in pairs to define nestable supports 40. The nestable supports 40 are secured to the grid 20 to support the grid and in turn the perimeter frame 12 above an underlying surface. Each of the U-shaped members 30 has a pair of legs 32 joined at respective base ends 34 to a base member 36. The legs 32 further have outer ends 38 opposite the base ends 34 which are spaced apart.

The generally U-shaped support members 30 would typically each be bent from a single piece of wire. Securement to the grid would be typically by welding, such as spot welding to the grid wires. In order to facilitate welding and improve resiliency, the legs 32 may bend toward the grid wires as illustrated at 42.

The pair of generally U-shaped members 30 in the nestable supports 32 need not be attached at the respective base portions 36 although they may be should this be desired. Generally the nestable box spring foundation 10 will be secured to a base member having wooden slats (not illustrated) with the base portions 36 stapled or otherwise secured to the slats. Accordingly, the base portions 36 may be held in alignment through further securement to a slat rather than by direct connection one to the other.

The legs 32 diverge from each other from the base end toward the outer end and accordingly the resulting nestable supports 40 generally resemble a pyramid, albeit flattened at one end. Although the expression "generally U-shaped" is utilized it is not intended to be limiting. The structures illustrated may also be considered at a "flattened V". Generally what is intended is a structure that has two legs 32 which are either parallel or diverging with the legs joined at one end and having spaced apart ends opposite the joined end. The expression "joined" does not require that the members be made up of individual parts, but may define a structure which is continuous and which may, as suggested above, be formed by bending.

Various arrangements exist for joining wire in box spring foundations. Although most of these could be used in the present arrangement, from the standpoint of maximizing manufacturing speed and minimizing cost it is expected that welding will be utilized. Other methods may include the use of clips or winding one of the wires about another.

The structure of the box spring foundation 10 is illustrated as having the ends 38 of the generally U-shaped members 30 secured to the longitudinally extending wires 22. While this is a present and preferred embodiment, the nestable supports 40 may be rotated 90 degrees from what is illustrated to have the ends 38 secured to the laterally extending grid wires 24.

It is generally not necessary to have a nestable support 40 beneath each of the grid openings 26. Accordingly the nestable supports 40 would typically be spaced apart by one grid opening both longitudinally and laterally. Longitudinal spacing would generally be a function of the slat spacing of the underlying frame (not illustrated). Lateral spacing would generally be determined by the number of grid openings which in turn would be a function of the desired degree of rigidity balanced with minimizing material usage.

Figure 5:
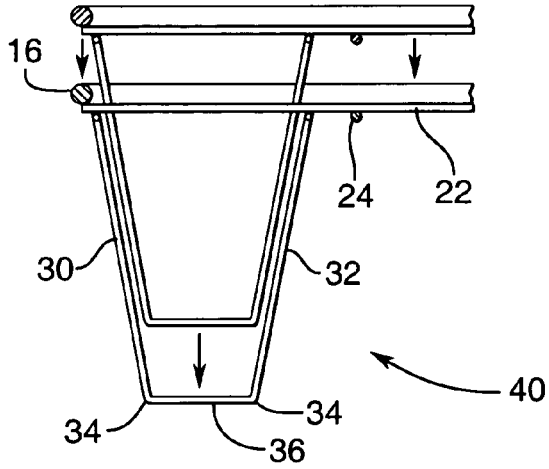
FIG. 5 is a partial sectional view on line 5-5 of view FIG. 3 showing two of the units in the process of being stacked.
Figure 7:
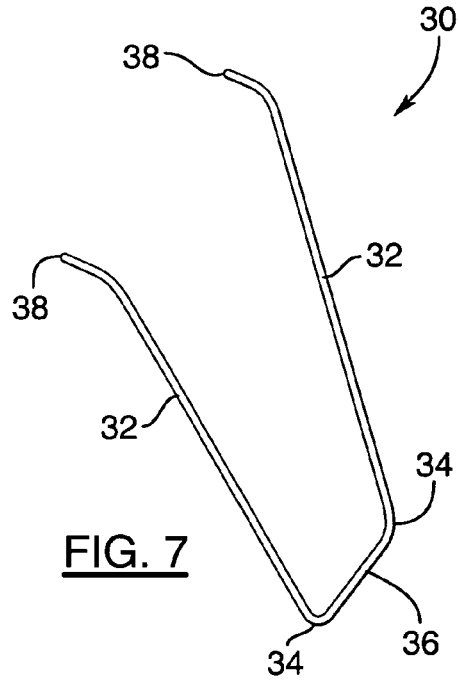
Figure 6:
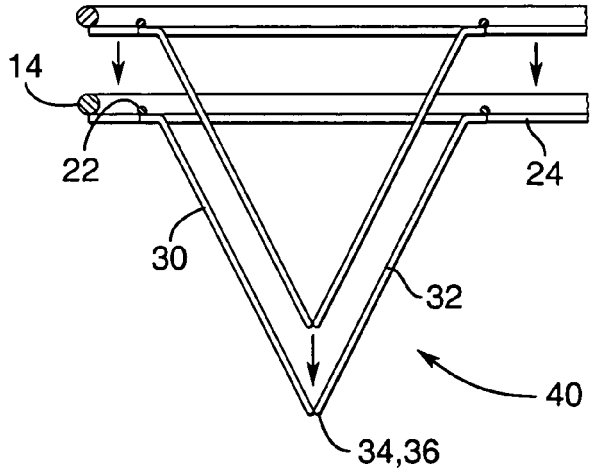
FIG. 6 is a partial sectional view on line 6-6 of FIG. 3 showing two of the units in the process of being stacked; and, FIG. 7 is a perspective view of one embodiment of a generally U-shaped support member according to the present invention.

Nestable stacking of the box spring foundations 10 is illustrated in FIGS. 5 and 6 and is made possible by virtue of the open grid structure and pyramidal upwardly opening nestable supports 40 and the grid openings 26.

The generally U-shaped support members 30, the longitudinally extending grid wires and laterally extending wires 24 may be made from wire having a similar thickness. This may for example be (without being limiting), steel wire having a gauge of from 10 to 6, with 10 gauge presently being preferred from a cost versus strength consideration.

Although not entirely necessary, it is generally expected that the rectangular perimeter frame 12 will be of a heavier gauge material than the grid 20 and the nestable supports 40. Generally stiffness is expected from the rectangular perimeter frame whereas the grid 20 and nestable supports 40 preferentially have more resiliency in order to maximize comfort. Accordingly, by way of example (without being limiting), the perimeter frame may be steel wire of from 3 to 6 gauge with 6 gauge presently being preferred.

The above description is intended in an illustrative rather than a restrictive sense and variations to the specific structure as described may be apparent to those skilled in the art without departing from the invention which is defined in the claims set out below.

PARTS LIST

10 nestable box spring foundation
12 rectangular perimeter frame
14 sides (of frame)
16 ends (of frame)
20 grid
22 longitudinally extending wires
24 laterally extending wires
26 grid openings
30 generally U-shaped member
32 legs
34 base end of legs
36 base portions
38 outer end of legs
40 nestable support
42 outwardly bent ends

The invention claimed is:

1. A nestable box spring foundation comprising: a generally rectangular perimeter frame having four sides; a grid having longitudinally and laterally extending grid wires secured at opposite ends to said perimeter frame to define a plurality of generally rectangular openings across said perimeter frame; and, pairs of generally U-shaped support members having a pair of legs joined at respective base ends thereof to a base portion and spaced apart at respective outer ends thereof opposite said respective base ends, said pairs of support wire members being welded at their outer ends to adjacent grid wires such that the base portions of each support wire member are fixedly held adjacent to each other, to thereby define a plurality of open generally pyramidal supports opening toward but extending away from said grid for supporting said grid and in turn said perimeter frame, wherein the paired wire support members are mounted within alternate grid openings only and do not extend across adjacent grid openings such that the paired wire support members are spaced apart by at least one grid opening, and wherein a plurality of said paired wire support members are positioned along each of the four sides of the box spring adjacent the generally rectangular frame; said supports being nestable in corresponding supports of an adjacent of said nestable box spring foundation.

2. The nestable box spring foundation as claimed in claim 1 wherein: said support members are mounted in said pairs in alternate of said rectangular openings.

3. The nestable box spring foundation as claimed in claim 2 wherein: said legs of said support members diverge toward said outer ends; and, said outer ends are secured either to said longitudinally extending grid wires or to said laterally extending grid wires.

4. The nestably stackable box spring foundation as claimed in claim 3 wherein: said perimeter frame has opposite sides and opposite ends; said longitudinally extending grid wires are generally parallel to said sides; and, said laterally extending grid wires are generally parallel to said ends.

5. The nestably stackable box spring foundation as claimed in claim 4 wherein: said grid wires are secured to one another and to said perimeter frame by welding.

6. The nestably stackable box spring foundation as claimed in claim 5 wherein: said legs of said support members bend toward said grid wires to which they attach adjacent said outer ends.

7. The nestably stackable box spring foundation as claimed in claim 6 wherein: said support members attach to said longitudinally extending grid wires.

8. The nestable box spring foundation as claimed in claim 1 wherein each of the pair of U-shaped support members include adjacent base portions that are held in alignment abutting each other through securement means.

9. A nestably stackable box spring foundation comprising: a generally rectangular perimeter frame having opposite sides and opposite ends; a grid having longitudinally and laterally extending wires to define grid openings, said longitudinally extending wires being generally parallel to said ends and secured to said sides; a plurality of nestable supports extending away from said grid to support said grid and in turn said perimeter frame, said supports further comprising a pair of generally U-shaped support members each having a pair of legs extending away from respective adjacent base portions toward respective outer ends thereof, and each being welded at said respective outer ends to a different one of an adjacent pair of said laterally extending or said longitudinally extending wires such that the base portions of each wire support member are fixedly held adjacent to each other, wherein the paired wire support members are mounted within alternate grid openings only and do not extend across adjacent grid openings such that the aired wire support members are spaced apart by at least one grid opening, and wherein a plurality of said paired wire support members are positioned adjacent to and alone each of the opposite sides and opposite ends of the generally rectangular frame.

10. The nestably stackable box spring foundation of claim 9 wherein: said supports are arranged in rows and columns with adjacent of said supports being spaced apart from each other by a grid opening.

11. The nestably stackable box spring foundation of claim 10 wherein: said legs of each said support member diverge from said base toward said outer ends.

12. The nestably stackable box spring foundation of claim 11 wherein: said legs of said support members are bent, adjacent their outer ends toward said wires to which they attach.

13. The nestably stackable box spring foundation of claim 12 wherein: said wires are secured to one another and said perimeter frame by welding.

14. The nestably stackable box spring foundation of claim 9 wherein each of the pair of U-shaped support members include adjacent base portions that are held in alignment abutting each other through securement means.

15. A nestable box spring foundation comprising: a generally rectangular perimeter frame having four sides; a grid having longitudinally and laterally extending grid wires secured at opposite ends to said perimeter frame to define a plurality of generally rectangular openings across said perimeter frame; and, pairs of generally U-shaped support members having a pair of legs joined at respective base ends thereof to a base portion and spaced apart at respective outer ends thereof said pairs of support wire members being welded at their outer ends to adjacent grid wires such that the base portions of each support wire member are fixedly held adjacent to each other, to thereby define a plurality of open generally pyramidal supports opening toward but extending away from said grid for supporting said grid and in turn said perimeter frame; wherein the pair of U-shaped support members are attached at their respective base portions by direct connection of each base portion to the other; and wherein the paired wire support members are mounted within alternate grid openings only and do not extend across adjacent grid openings such that the paired wire support members are spaced apart by at least one grid opening, and wherein a plurality of said paired wire support members are positioned along each of the four sides of the box spring adjacent the generally rectangular frame, said supports being nestable in corresponding supports of an adjacent of said nestable box spring foundation.

16. A nestably stackable box spring foundation comprising: a generally rectangular perimeter frame having opposite sides and opposite ends; a grid having longitudinally and laterally extending wires to define grid openings, said longitudinally extending wires being generally parallel to said ends and secured to said sides; a plurality of nestable supports extending away from said grid to support said grid and in turn said perimeter frame, said supports further comprising a pair of generally U-shaped support members each having a pair of legs extending away from respective adjacent base portions toward respective outer ends thereof, and each being welded at said respective outer ends to a different one of an adjacent pair of said laterally extending or said longitudinally extending wires such that the base portions of each wire support member are fixedly held adjacent to each other, wherein the pair of U-shaped support members are attached at their respective base portions by direct connection of each base portion to the other, and wherein the paired wire su port members are mounted within alternate grid openings only and do not extend across adjacent grid openings such that the paired wire support members are spaced apart by at least one grid opening, and a plurality of said paired wire support members are positioned adjacent to and along each of the opposite sides and opposite ends of the generally rectangular frame.

* * * * *